US007746332B2

(12) United States Patent
Le Leannec et al.

(10) Patent No.: US 7,746,332 B2
(45) Date of Patent: Jun. 29, 2010

(54) METHOD AND DEVICE FOR DECODING AN IMAGE

(75) Inventors: Fabrice Le Leannec, Mouaze (FR); Patrice Onno, Rennes (FR)

(73) Assignee: Canon Kabushiki Kaisha, Tokyo (JP)

( * ) Notice: Subject to any disclaimer, the term of this patent is extended or adjusted under 35 U.S.C. 154(b) by 918 days.

(21) Appl. No.: 11/568,174

(22) PCT Filed: Apr. 20, 2005

(86) PCT No.: PCT/IB2005/001470

§ 371 (c)(1),
(2), (4) Date: Oct. 20, 2006

(87) PCT Pub. No.: WO2005/104085

PCT Pub. Date: Nov. 3, 2005

(65) Prior Publication Data

US 2007/0216699 A1 Sep. 20, 2007

(30) Foreign Application Priority Data

Apr. 23, 2004 (FR) ..... 04 04338

(51) Int. Cl.
*G09G 5/00* (2006.01)

(52) U.S. Cl. ..... 345/204; 348/420.1; 348/429.1; 382/232

(58) Field of Classification Search ..... 345/684–689, 345/555; 348/714, 565, 716, 564, 563; 382/248, 382/100, 282, 293, 232
See application file for complete search history.

(56) References Cited

U.S. PATENT DOCUMENTS

| | | | | |
|---|---|---|---|---|
| 6,556,252 | B1 * | 4/2003 | Kim | 348/565 |
| 2002/0051504 | A1 | 5/2002 | Onno | 375/340 |
| 2003/0025716 | A1 * | 2/2003 | Colavin | 345/684 |
| 2003/0235325 | A1 * | 12/2003 | Ray et al. | 382/100 |

FOREIGN PATENT DOCUMENTS

| | | |
|---|---|---|
| EP | 0 810 552 | 12/1997 |
| JP | 2003-173179 | 6/2003 |
| WO | WO 03/056542 A2 | 7/2003 |

* cited by examiner

*Primary Examiner*—Kevin M Nguyen
(74) *Attorney, Agent, or Firm*—Fitzpatrick, Cella, Harper & Scinto

(57) ABSTRACT

In order to decode and display a previously compressed digital image portion, a first portion of this image being previously decoded and displayed in a first display window:—a request of a user defining a direction of movement in the image is read (115);—a new display window in the image is determined (119) as a function of this movement;—at least one area to be decoded and a decoding direction is determined (121) from the relative position of the new display window with respect to the first display window and this area is decoded and displayed (125, 127, 129) according to the decoding direction determined.

21 Claims, 14 Drawing Sheets

METHOD AND DEVICE FOR DECODING AN IMAGE

This application claims priority from French patent application No. 04 04338 filed on Apr. 23, 2004, which is incorporated herein by reference, The present invention relates to a method and device for decoding an image.

The invention relates to the field of the interactive display of digital images.

It is described here in as way that does not limit its application to images in accordance with the JPEG2000 standard.

JPEG2000 interactive image display applications in particular enable a user to move spatially in an image.

This functionality is generally implemented by means of scroll bars of the graphical interface, arrow keys on the keyboard of a computer or via the movement of the image displayed by means of the mouse.

The interactive JPEG2000 applications envisaged here allow both the display of so-called "local" images, that is to say images stored in the computer where the application is being executed, and the display of distant images, located on a JPIP (JPEG2000 Interactive Protocol) server. In this second case, the application progressively repatriates, via the JPIP protocol, the areas of interest successively selected by the user. The present invention applies to these two practical cases.

The problem posed here concerns the strategy of partial decoding and display of the displayed image, when the user makes a spatial movement in the image.

In existing JPEG2000 graphical applications, the missing image portion is always decoded and displayed from top to bottom, that is to say from the highest lines of pixels to the lowest.

However, according to the movement made in the JPEG2000 image by the user, this approach may give rise to discontinuities in the image portions displayed on the screen. These discontinuities may be visually unpleasant.

In order to improve the quality of the visual rendition, the present invention proposes to decode and display the required area, either from top to bottom or from bottom to top. It also proposes a strategy of choice of the direction of decoding and display, as a function of the movement made in the image. In addition, it is Important to decode and display as a matter of priority the uncovered or missing spatial areas resulting from the spatial movement. To do this, a calculation of the rectangular areas to be decoded is proposed by the present invention.

For the purpose indicated above, the present invention proposes a method of decoding and displaying a previously compressed digital image portion, a first portion of this image being previously decoded and displayed in a first display window, this method being remarkable in that it comprises steps consisting of:

- reading a request of a user defining a movement direction in the image;
- determining a new display window in the image as a function of this movement;
- determining at least one area to be decoded and a decoding direction from the relative position of the new display window with respect to the first display window;
- decoding and displaying this at least one area according to the decoding direction determined.

Thus, following a spatial movement made by a user in an image towards a non-decoded portion thereof, the present invention makes it possible to determine a strategy of choice of the direction of decoding and restoration of the image as well as a strategy of choice of the portions to be decoded in order to fill in the missing area. The choice of the decoding direction may lead to a decoding from the bottom to the top of the image.

This makes it possible in particular to improve the quality of the visual rendition in an interactive application, avoiding obtaining on the screen, during decoding, non-connected displayed image portions.

In addition, the decoding method according to the invention does not introduce any additional cost, in terms of decoding complexity, compared with the existing strategies.

In addition, the mechanism proposed is very simple to embody, starting from an existing implementation.

In a particular embodiment, the digital image was previously compressed by spatio-frequency transformation, quantization and entropic coding steps.

In a particular embodiment, the decoding step comprises an inverse wavelet transform substep proceeding by successive lines of samples.

This makes it possible, in addition to a low consumption of memory space, to supply the graphical interface with lines of pixels as they are decoded. Thus the graphical interface is able to begin the display of the successive lines of pixels without waiting for the whole of the aforementioned area to be decoded.

In a particular embodiment, the decoding and display step is carried out from the bottom to the top of the image if the value of the ordinate of the new display window is strictly less than the value of the ordinate of the first display window in a predetermined reference frame and the decoding and display step is carried out from the top to the bottom of the image in the contrary case.

This embodiment guarantees the absence of spatial discontinuities between the image part still displayed resulting from the first display window and the area or areas currently being decoded and displayed in the new display window. The result is better visual comfort due to the elimination of the annoyance relating to the presence of spatial discontinuities.

In a particular embodiment, in the case of a bidirectional movement made in the image by the user, there are determined, during the step of determining at least one area to be decoded and a decoding direction:

- a first rectangular area, situated alongside the part of the aforementioned first portion still present in the new display window, with the same height as this part, and
- a second rectangular area, with a width equal to that of the new display window.

The result is a more rapid restoration of the missing image part after a movement made in the image by the user, by comparison with an approach which would consist of decoding and displaying the new display window in its entirety, that is to say without taking advantage of the image portion part still present in the new display window. In other words, this makes it possible to avoid unnecessarily decoding and displaying an image portion already available on the screen, since only the missing part in the new display window is decoded and displayed.

In this embodiment, according to a particular characteristic, during the step of determining at least one area to be decoded and a decoding direction, the same decoding direction to be applied to the first and second areas is determined.

This guarantees that the part of the image currently being decoded and displayed is always connected to the part already displayed. This results in the elimination of the visual annoyance due to a discontinuity between an image part already displayed and the image part currently being displayed.

In this same embodiment, during the decoding and display step, the second area is decoded and displayed after the first area.

Thus the missing L-shaped area is filled in a manner which is more natural to the eye, which increases visual comfort.

In a particular embodiment, the image is in accordance with the JPEG2000 standard.

The JPEG2000 format is said to be scalable in terms of resolution, quality and spatial position. Technically, this allows the decoding of a portion of the bitstream corresponding to any region of interest defined by a resolution level, a quality level or a rate, and a spatial area in the JPEG2000 image. These functionalities are very interesting for interactive applications of browsing in images, where it is wished for the user to be able to carry out zoom-in/zoom-out operations or spatial movements In the image, as is the case in the context of the present invention. The JPEG2000 format is particularly well adapted to these interactive applications of browsing in images, possibly in a network.

For the same purpose as indicated above, the present invention also proposes a device for decoding and displaying a previously compressed digital image portion, a first portion of this image being previously decoded and displayed in a first display window, this device being remarkable in that it comprises:

- a module for reading a request of a user defining a movement direction in the image;
- a module for determining a new display window in the image as a function of this movement;
- a module for determining at least one area to be decoded and a decoding direction from the relative position of the new display window with respect to the first display window;
- a module for decoding and displaying this at least one area according to the decoding direction determined.

The present invention also relates to a communication apparatus comprising a decoding device as above.

The present invention also relates to an information storage means which can be read by a computer or a microprocessor storing instructions of a computer program, enabling a decoding method as above to be implemented.

The present invention also relates to a partially or totally removable information storage means which can be read by a computer or a microprocessor storing instructions of a computer program, enabling a decoding method as above to be implemented.

The present invention also relates to a computer program product which can be loaded into a programmable apparatus, comprising sequences of instructions for implementing a decoding method as above, when this program is loaded into and executed by the programmable apparatus.

The particular features and the advantages of the decoding device, of the communication apparatus, of the storage means and of the computer program product being similar to those of the decoding method, they are not repeated here.

Other aspects and advantages of the invention will emerge from a reading of the following detailed description of a particular embodiment, given by way of non-limiting example. The description refers to the accompanying drawings, in which.

Figure 4A:
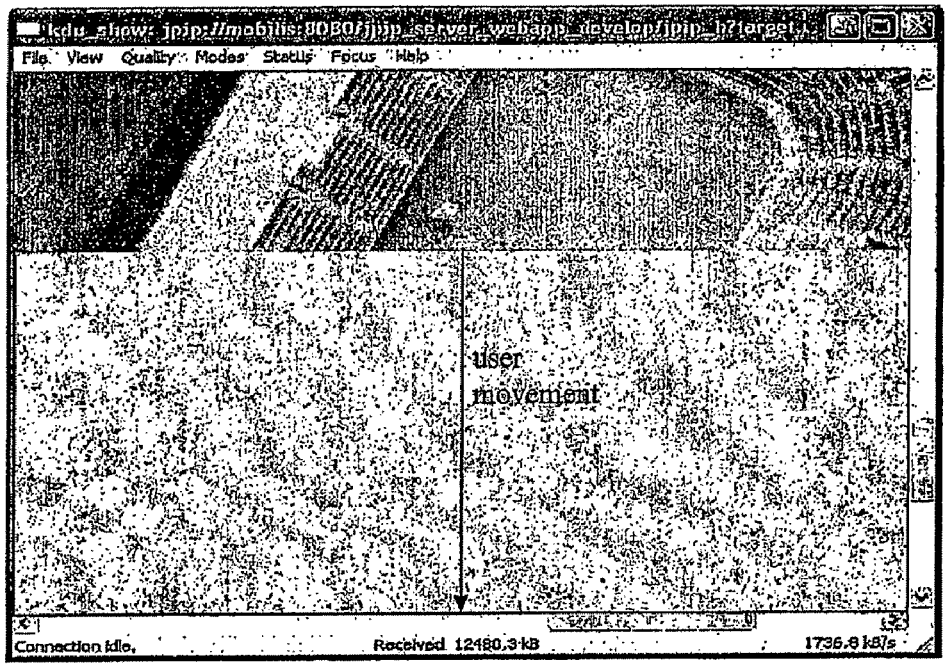
Figure 4B:
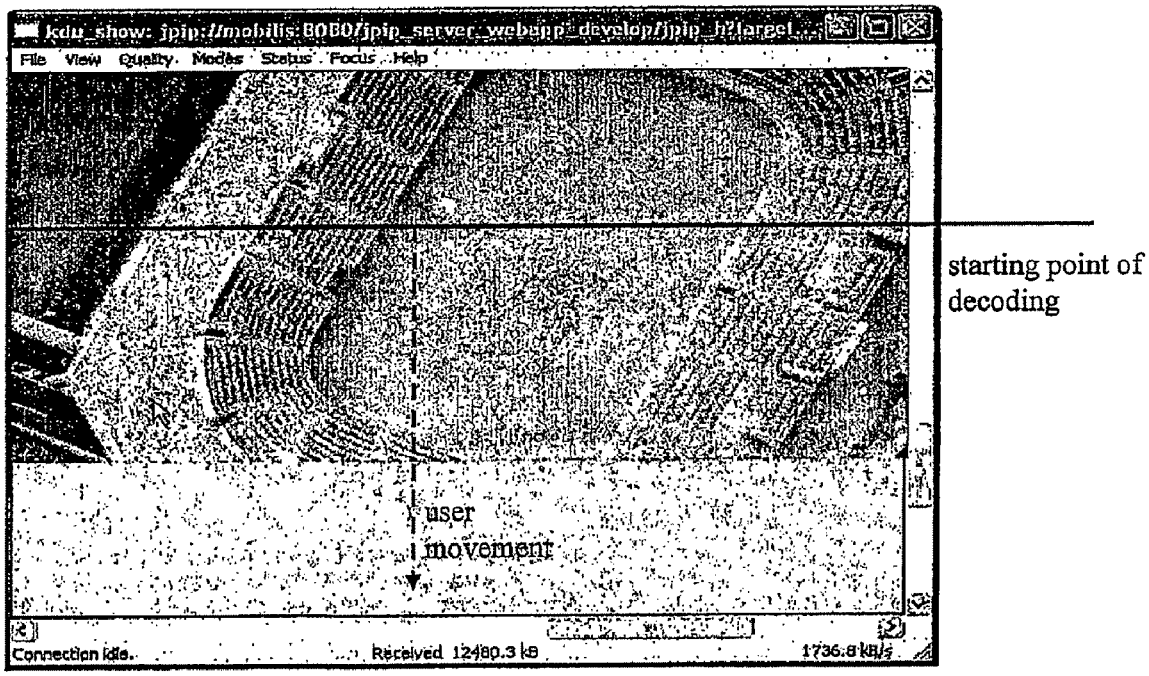
Figure 5A:
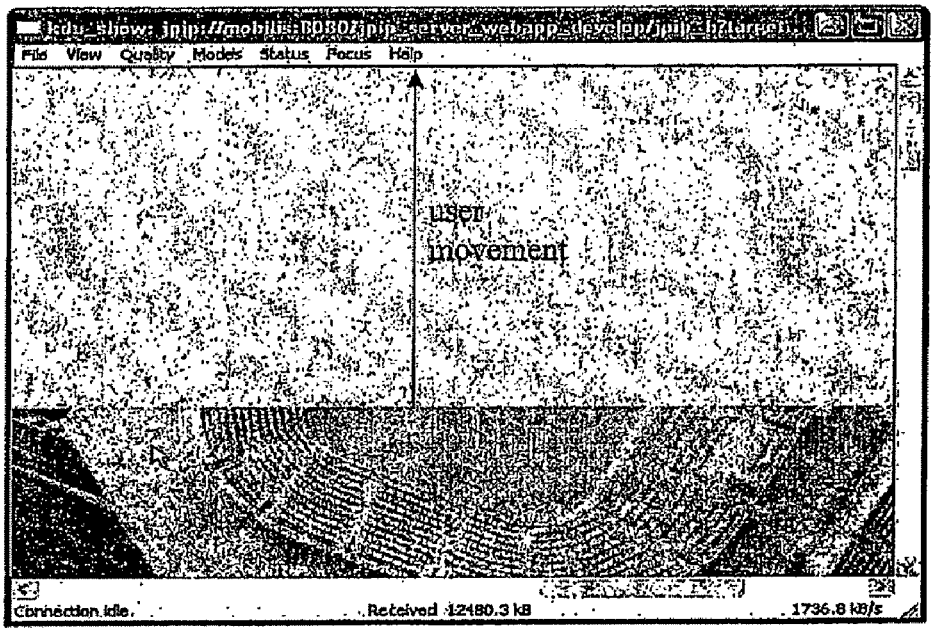
Figure 5B:
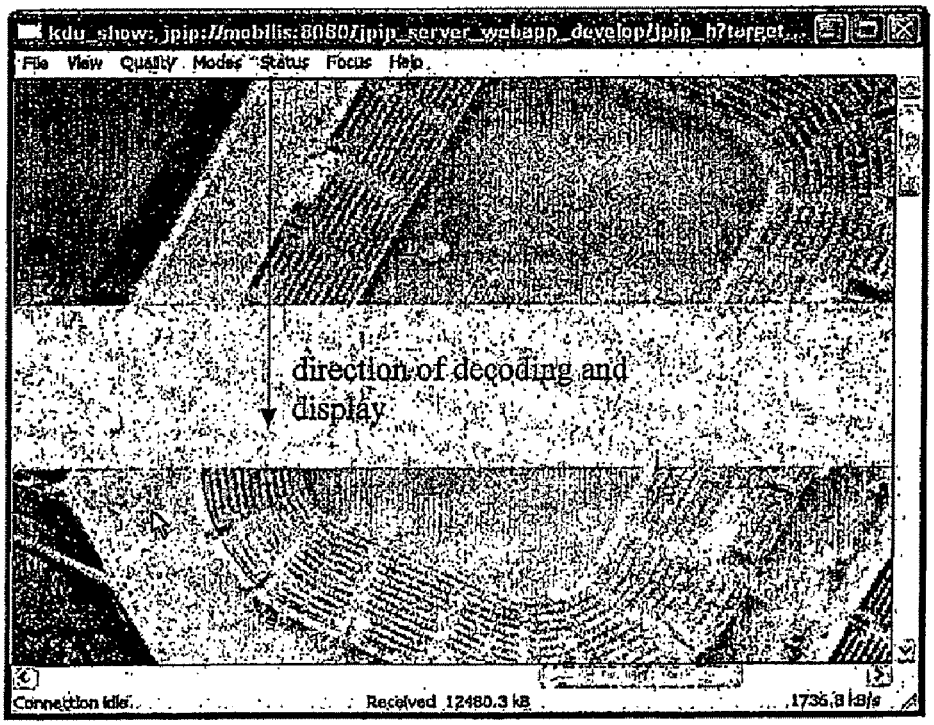
Figure 6:
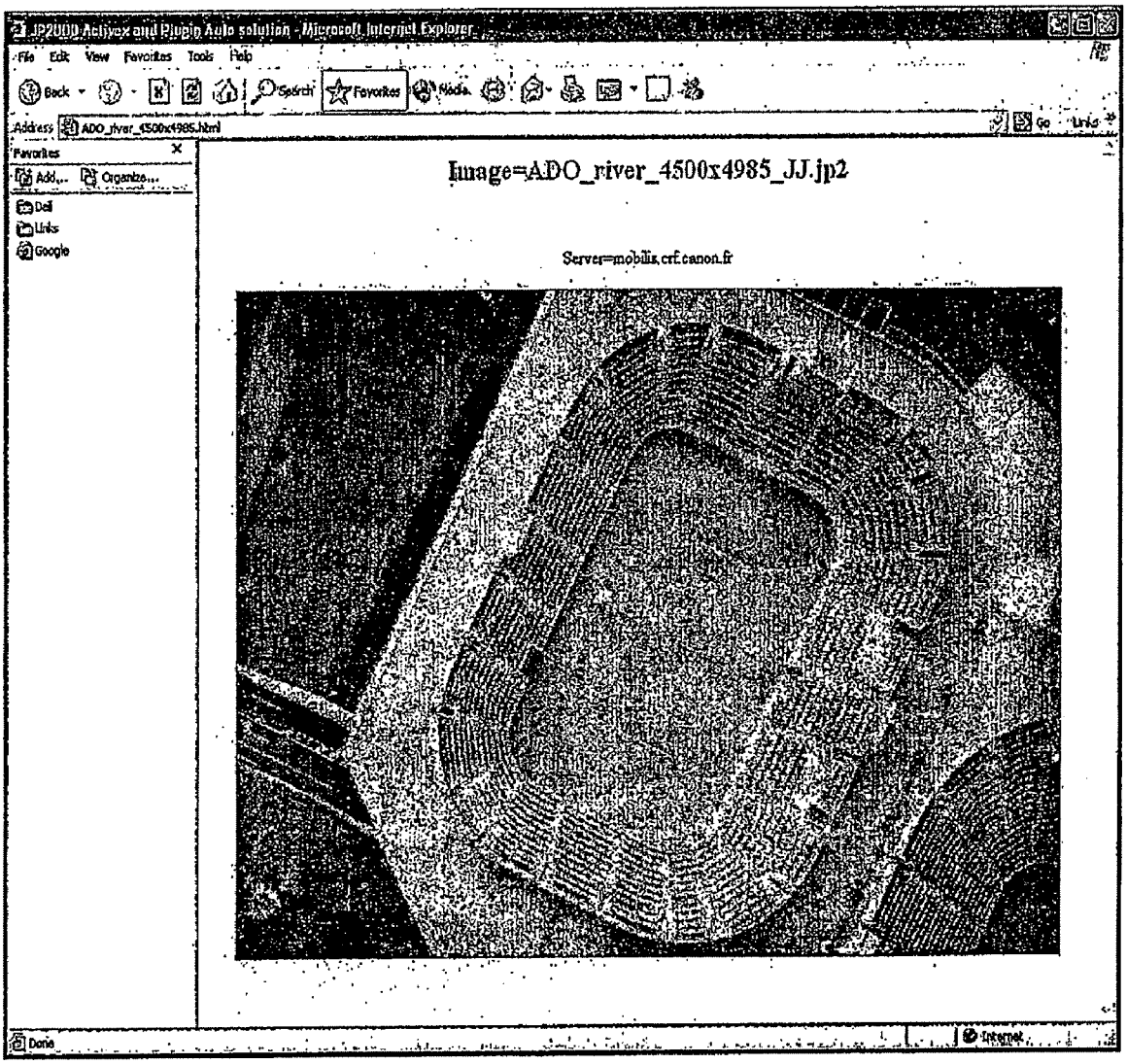
Figure 7A:
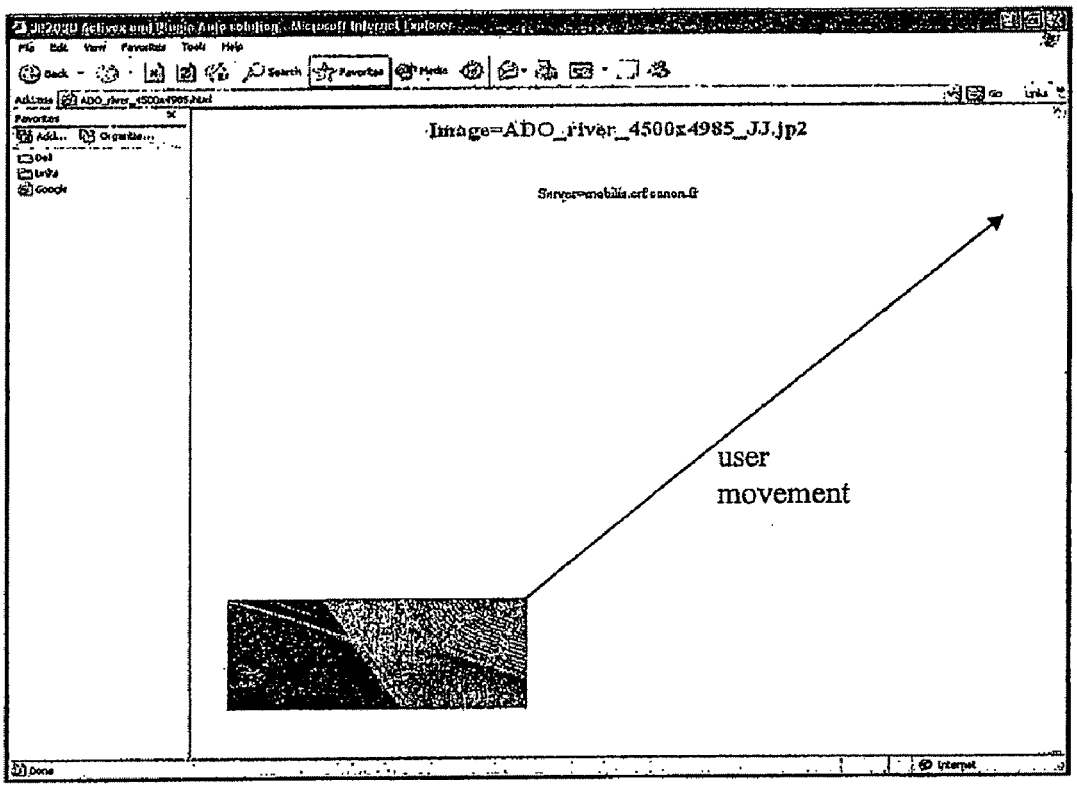
Figure 7B:
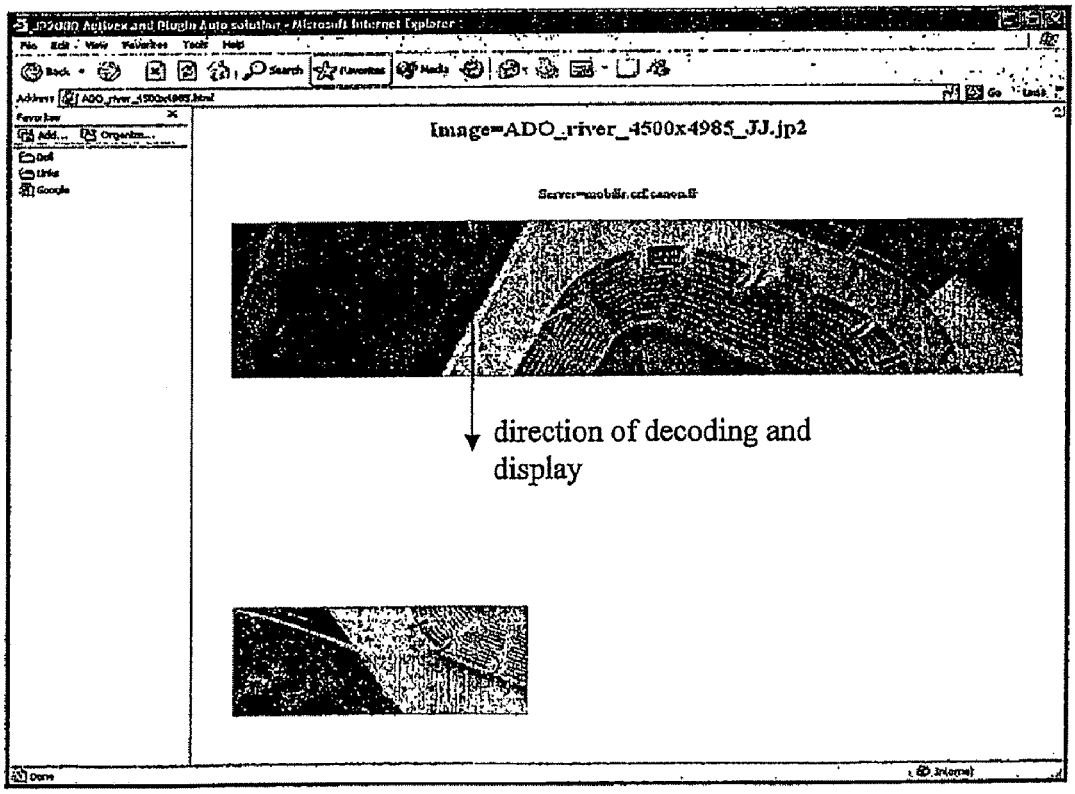
Figure 8:
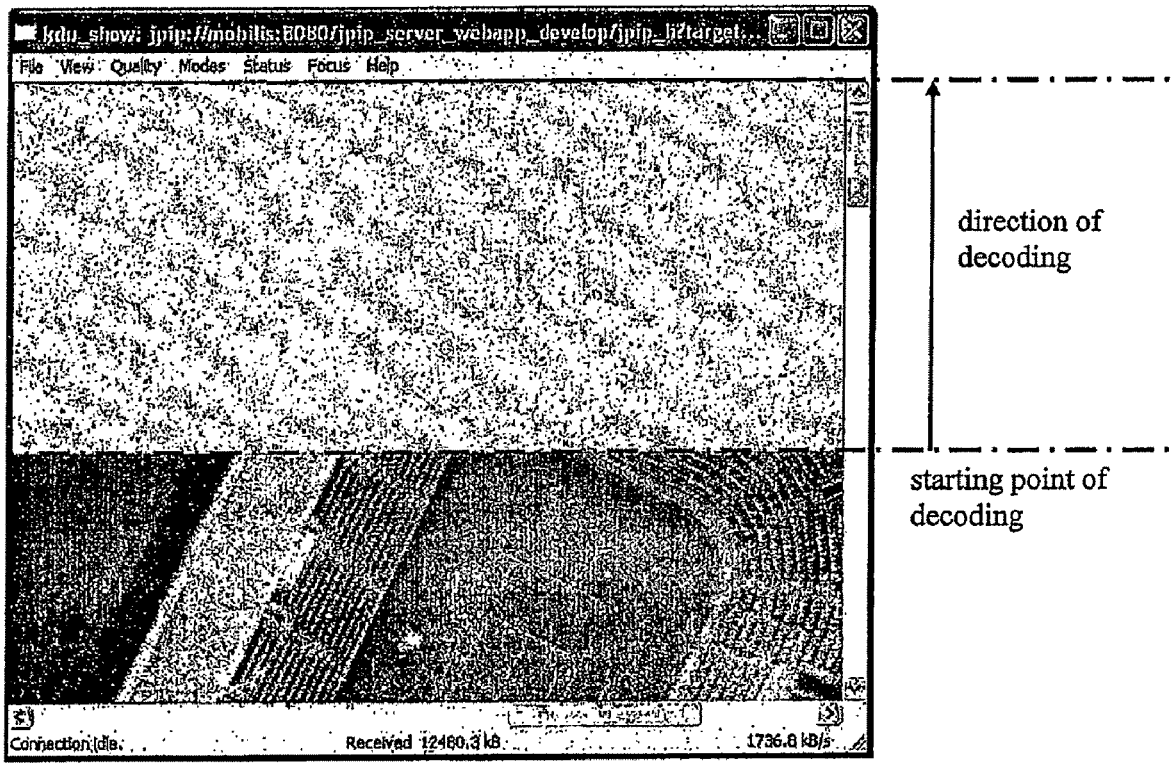
Figure 9A:
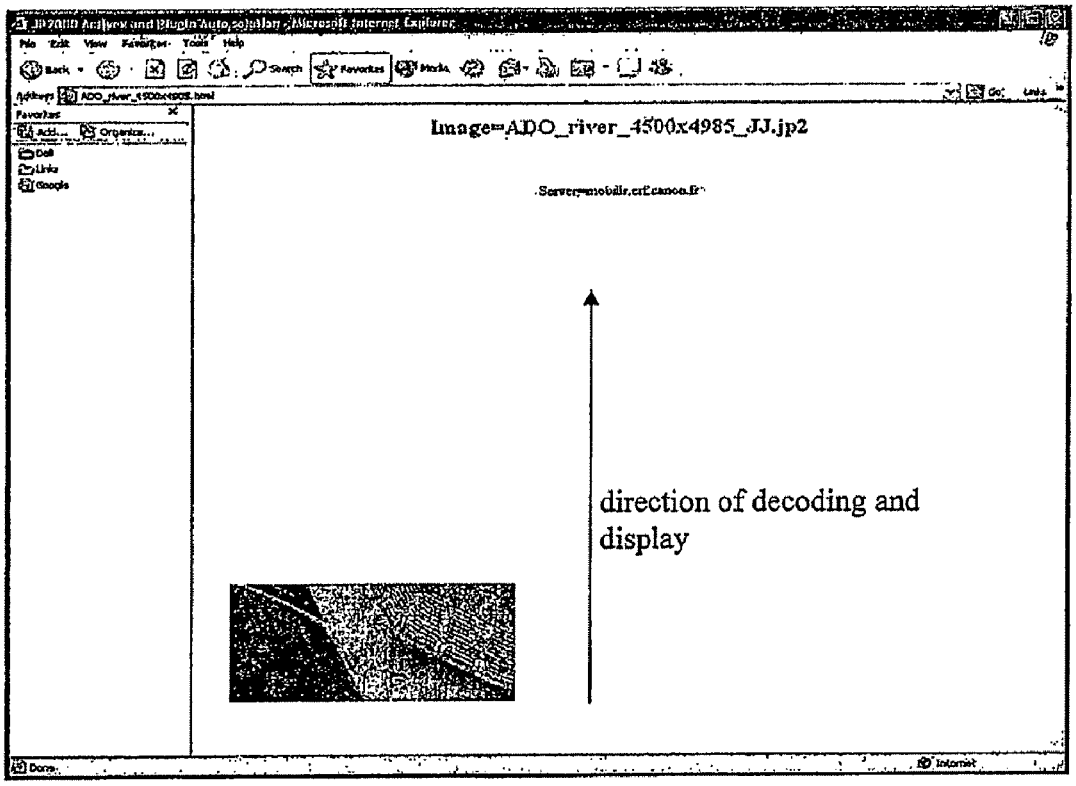
Figure 9B:
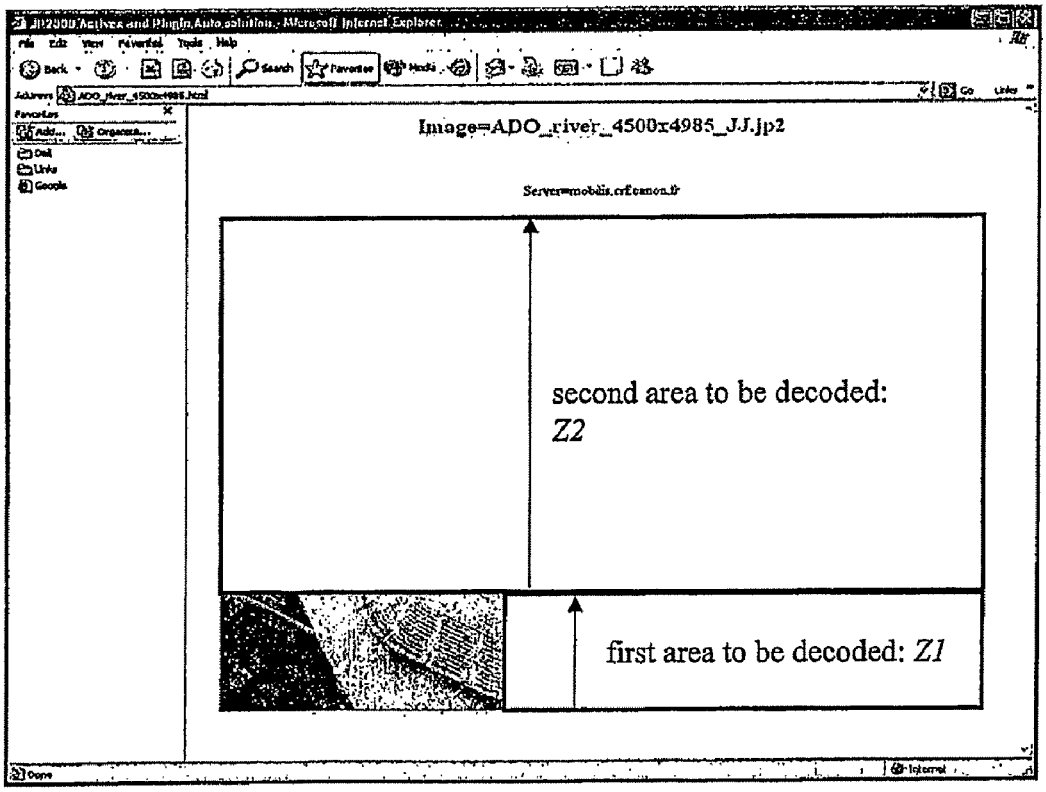

FIGS. 4*a* and 4*b* illustrate the conventional decoding and display strategy adopted by the Kakadu software during a spatial movement towards the bottom of the image made by the user;

FIGS. 5*a* and 5*b* show the drawback of this conventional strategy during a spatial movement towards the top of the image;

FIGS. 6, 7*a* and 7*b* illustrate the conventional decoding and display strategy adopted in the context of JPEG2000 plug-in software for an Internet browser and the drawback of this strategy during a spatial movement upwards and towards the right;

FIG. 8 illustrates the solution provided by the present invention during a movement towards the top of the image, in the context of the kdu_show graphical application;

FIGS. 9*a* and 9*b* illustrate the solution provided by the present invention in the case of a movement in two directions, in the context of the JPEG2000 plug-in software described in relation to FIGS. 6, 7*a* and 7*b;*

Figure 10:
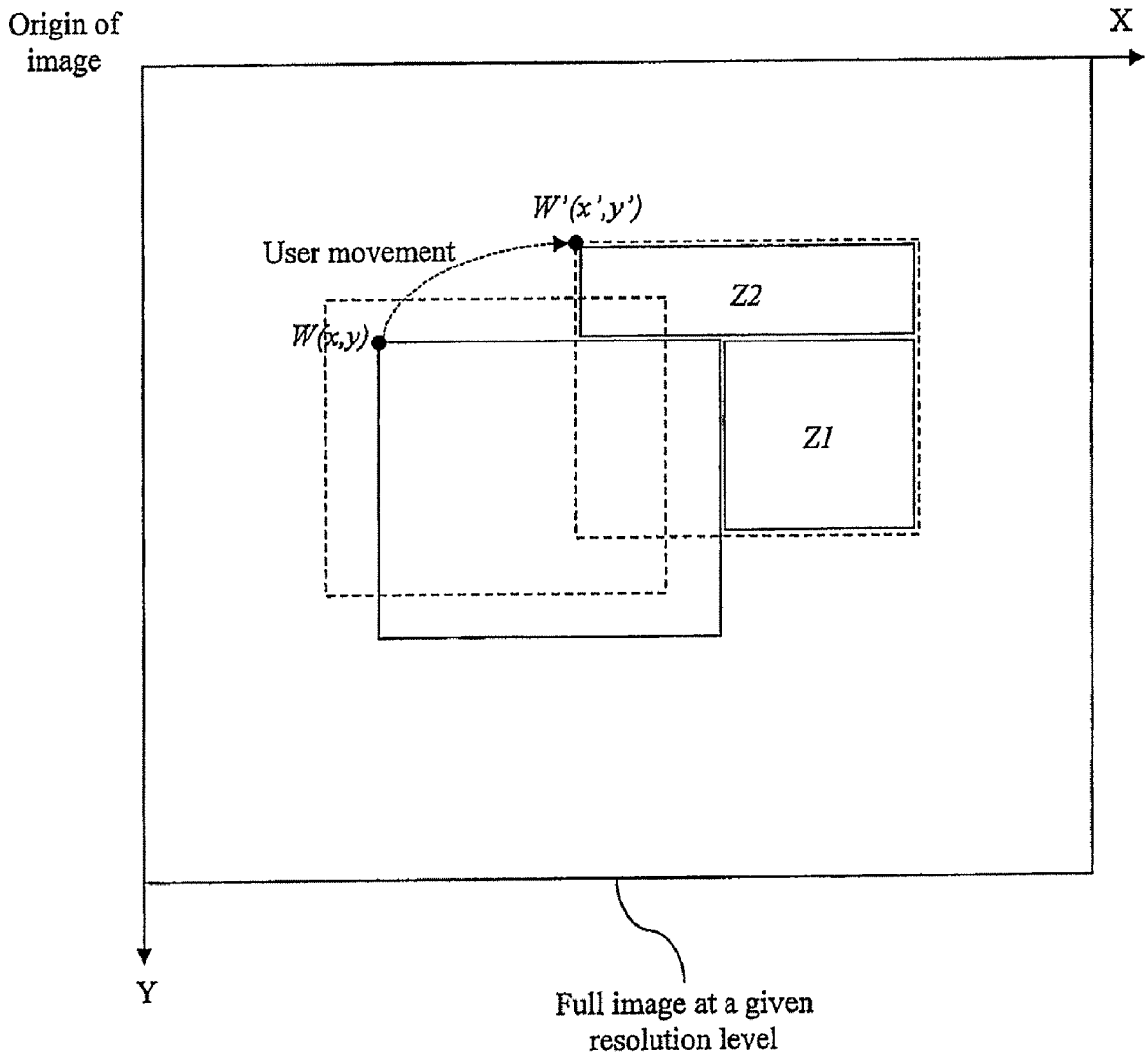
Figure 11:
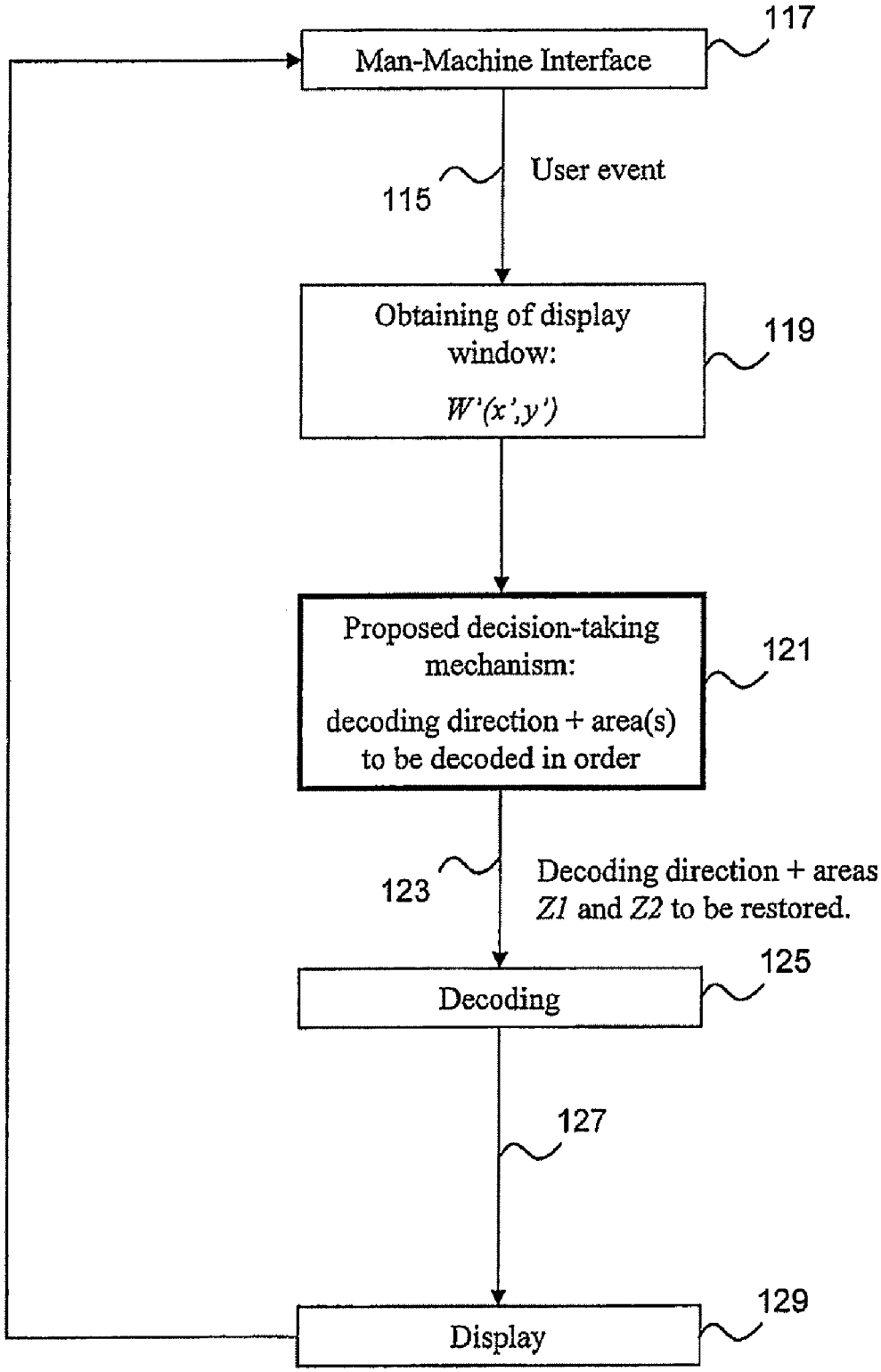
Figure 12:
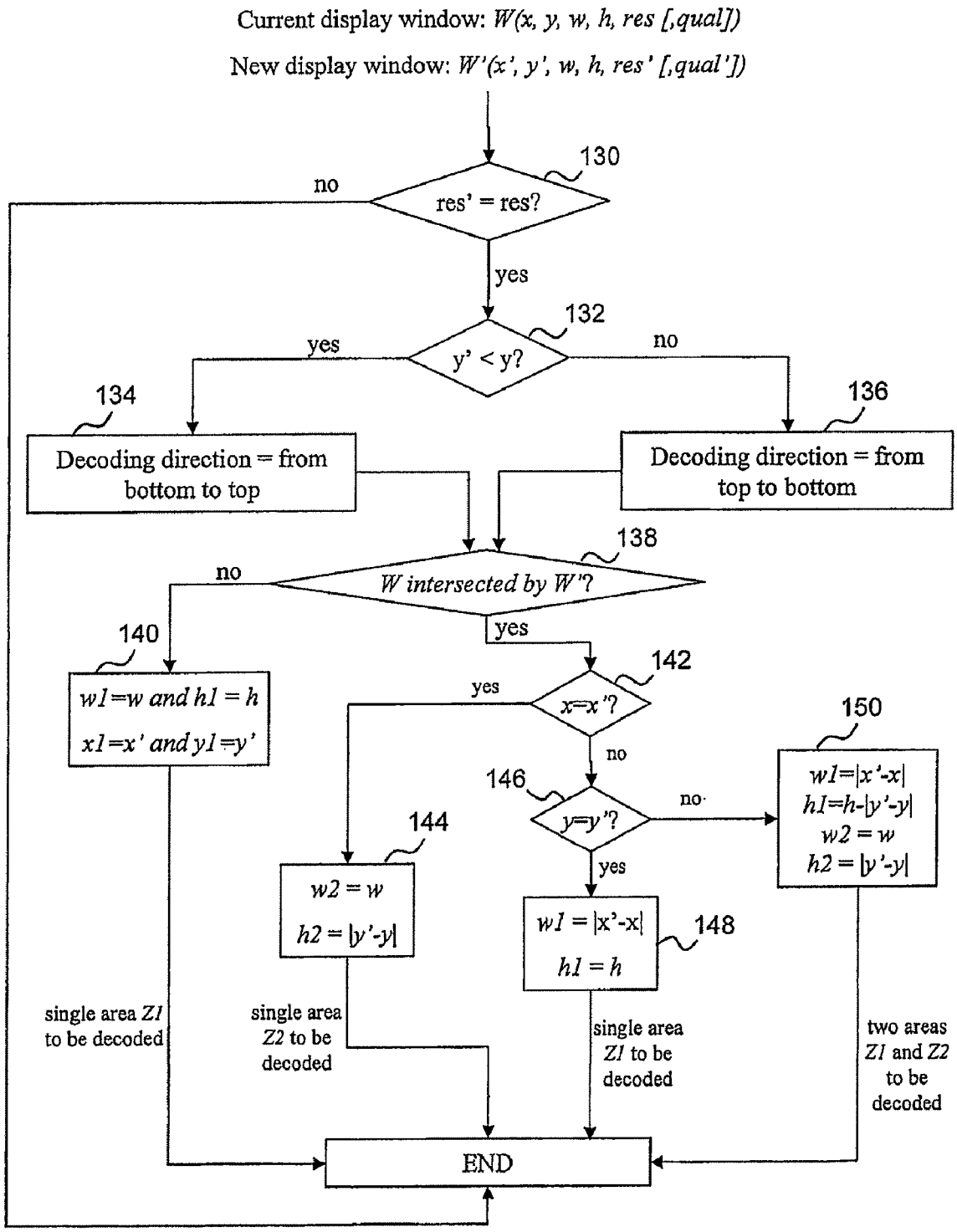
Figure 13A:
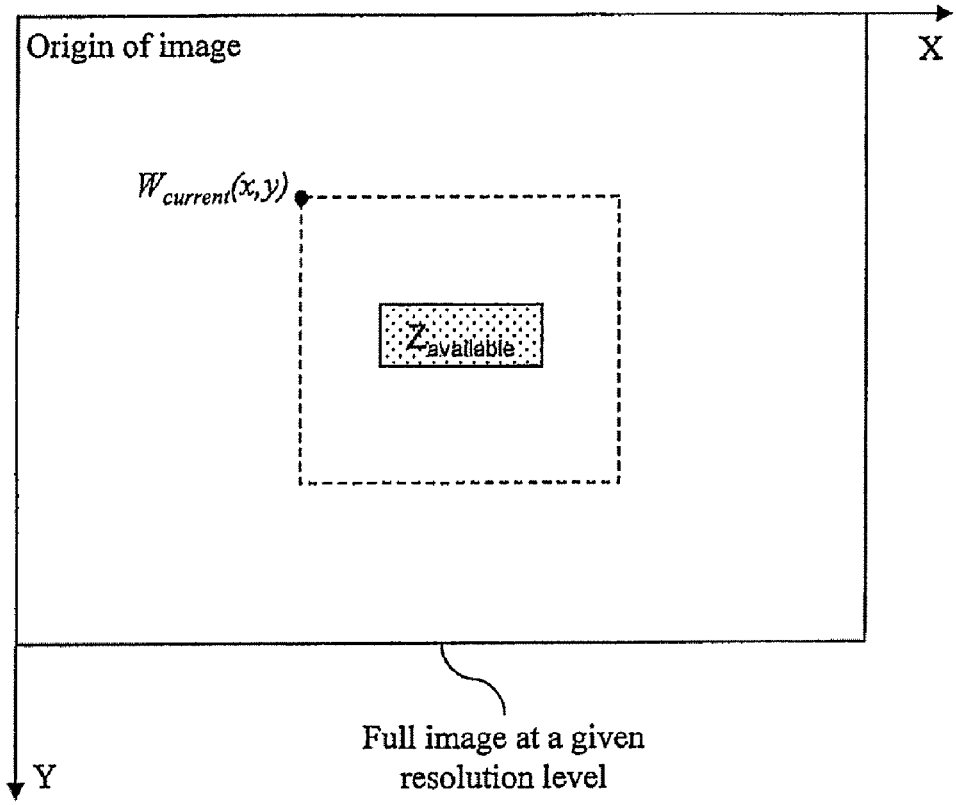
Figure 13B:
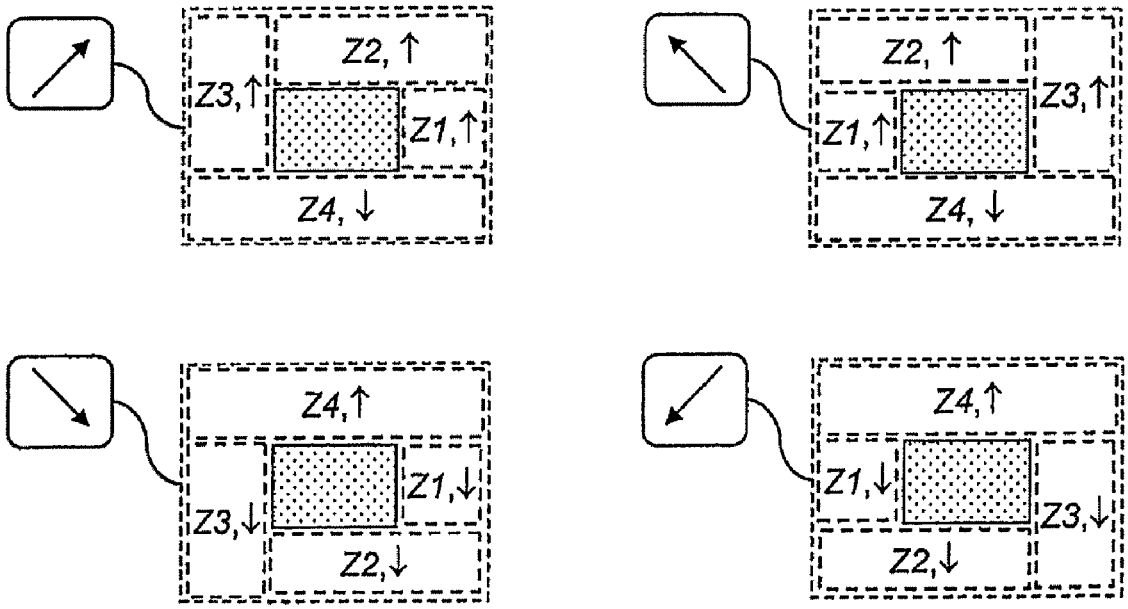
Figure 14:
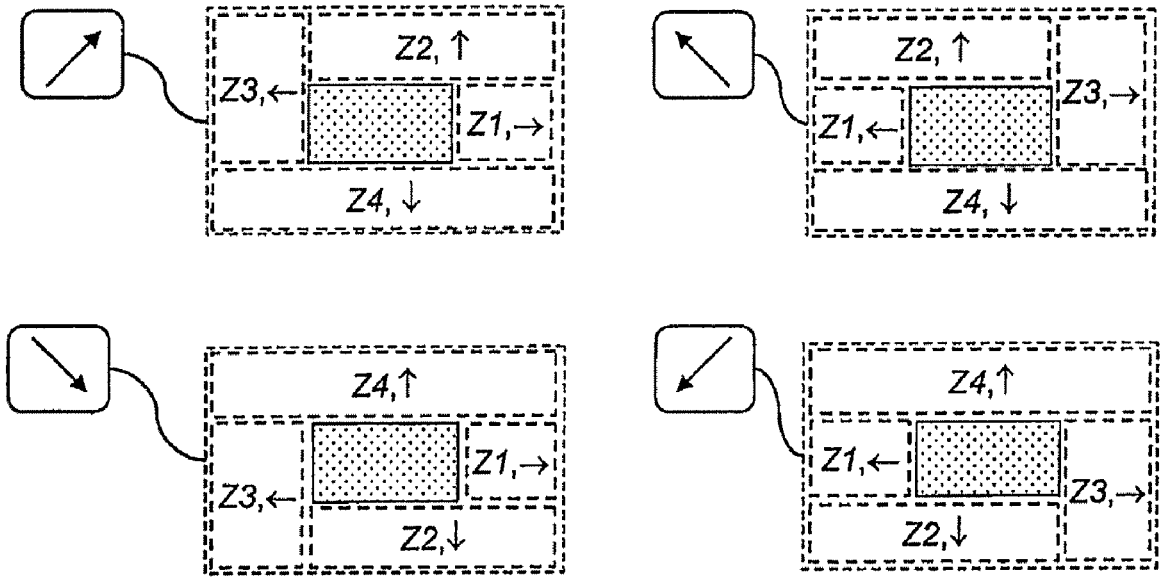

FIG. 10 illustrates the system of coordinates used by the present invention for defining rectangular portions of the image at a given resolution level;

FIG. 11 is a flow diagram illustrating the global functioning mode of an interactive graphical application implementing the decoding method according to the present invention, in a particular embodiment;

FIG. 12 is a flow diagram illustrating the decision algorithm with regard to the direction of decoding and the areas to be decoded included in the decoding method according to the present invention, in a particular embodiment;

FIG. 13*a* illustrates the available decoded image area and the missing area which are obtained after the decoding according to the present invention is completed, in the most general case where the user makes spatial movements in all possible directions in the image during the original decoding of a missing image area;

FIG. 13*b* illustrates the decision-taking process regarding the areas to be decoded and displayed, the order in which they should be decoded and displayed and the decoding/display direction, in the most general case where the user makes spatial movements in all possible directions in the image during the original decoding of a missing image area; and FIG. 14 illustrates another embodiment of the present invention, where the image is in accordance with Part 2 of the JPEG2000 standard and where the pixels are decoded column by column and the decoding is performed from the right to the left.

It will be recalled that, according to the JPEG2000 standard, a file is composed of an optional JPEG2000 preamble, and a codestream comprising a main header and at least one tile.

A tile represents a rectangular part of the original image in question that is compressed. Each tile is formed by a tile-part header and a set of compressed image data referred to as a tile-part bitstream.

Each tile-part bitstream comprises a sequence of packets. Each packet contains a header and a body. The body of a packet contains at least one code-block, a compressed representation of an elementary rectangular part of an image, possibly transformed into sub-bands. The header of each packet summarizes firstly the list of the code-blocks contained in the body in question and secondly contains compression parameters peculiar to each of these code-blocks.

Each code-block is compressed on several incremental quality levels: a base level and refinement levels. Each quality level or layer of a code-block is contained in a distinct packet.

A packet of a tile-part bitstream of a JPEG2000 file therefore contains a set of code-blocks, corresponding to a given tile, component, resolution level, quality level and spatial position (also called a "precinct").

Finally, the codestream portion corresponding to a tile can be divided into several contiguous segments referred to as tile-parts. In other words, a tile contains at least one tile-part. A tile-part contains a header (tile-part header) and a sequence of packets. The division into tile-parts necessarily therefore takes place at packet boundaries.

Figure 1:
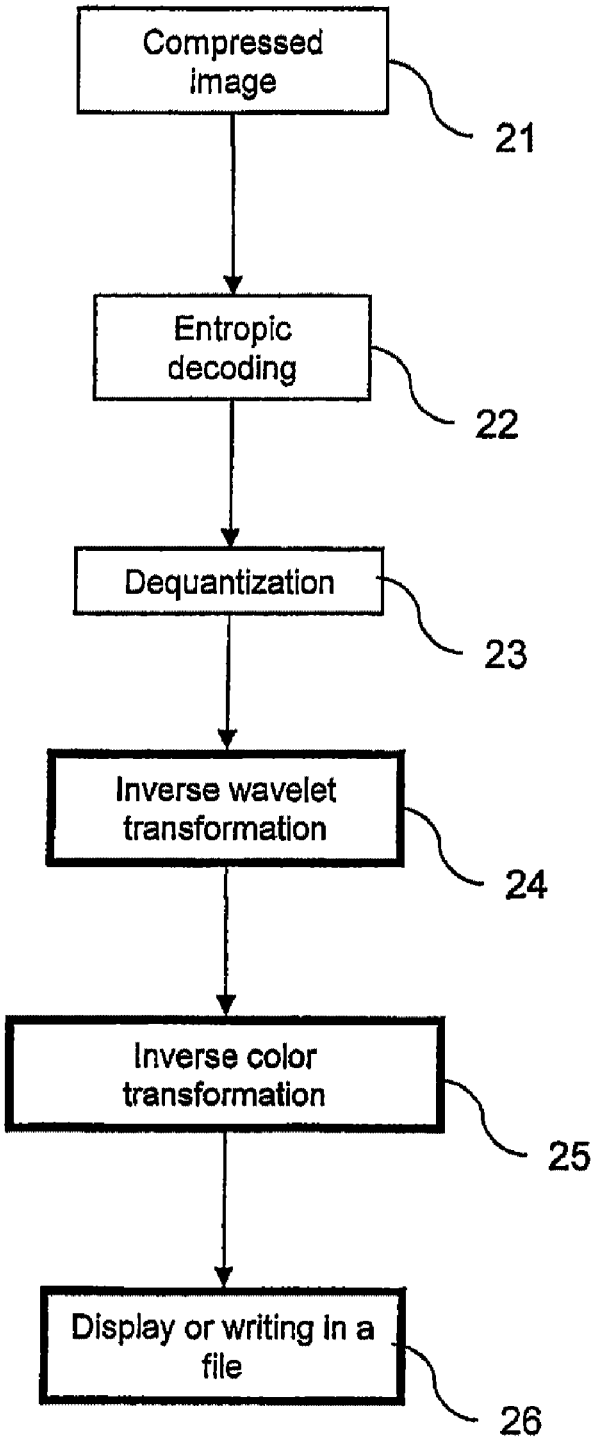
PRIOR ART FIG. 1
FIG. 1 depicts schematically all the modules present in a conventional JPEG2000 image decoder.

FIG. 1 shows schematically in a generic fashion all the modules present in any JPEG2000 image decoder. The JPEG2000 decoder processes compressed images 21 which have undergone a spatio-frequency transformation, a quantization and an entropic coding. These coding steps are conventional and will not be detailed here. As shown in FIG. 1, in the decoder, there are successively performed:

- the entropic decoding of the code-blocks (step 22);
- the inverse quantization of the previously decoded samples, which supplies dequantized wavelet coefficients (step 23);
- the inverse wavelet transform, which transforms the wavelet coefficients into reconstructed coefficients in each component of the image (step 24);
- the inverse color transform, which is optional, implemented when the original image has undergone a color transform (change from the red-green-blue space to luminance and chrominance components) at the time of its compression (step 25);
- the restoration of the image thus decoded, either by writing the decoded data in a file, or by supplying them to the graphical interface responsible for display (step 26).

In accordance with the present invention, the JPEG2000 decoder must be capable of proceeding either from the top to the bottom of the image, or from the bottom to the top.

In such a decoder, the modules acting at steps 24, 25 and 26 (framed in thick lines in FIG. 1) must be in a position to process the lines of pixels in any direction. These three modules in fact process the various tiles and components by lines of samples. To do this, each of these modules loops, for each tile and component, over the lines of samples constituting the image area to be decoded. Each line is run through from left to right and the lines are run through from top to bottom.

So that the decoder can operate from bottom to top, it therefore suffices to run through and process the lines of samples not from the first line to the last line, but from the last line to the first line. So that the decoder is capable of processing the successive lines of samples one by one and supplying them to the inverse color transform module, a particular implementation of the inverse wavelet transform module is provided for, wherein the transform is carried out by successive lines. With regard to the implementation of a wavelet transform, reference can usefully be made to document U.S. Pat. No. 6,523,051.

Depending on the architecture of the decoder and the nature of the data transferred between the dequantizer and the inverse wavelet transform, it is also possible, if necessary, to provide for the dequantizer to be capable of proceeding in both directions also.

Finally, a decoding option indicating the required direction for the decoding is added to the decoder, which then operates in the decoding direction which is specified to it.

Figure 2:
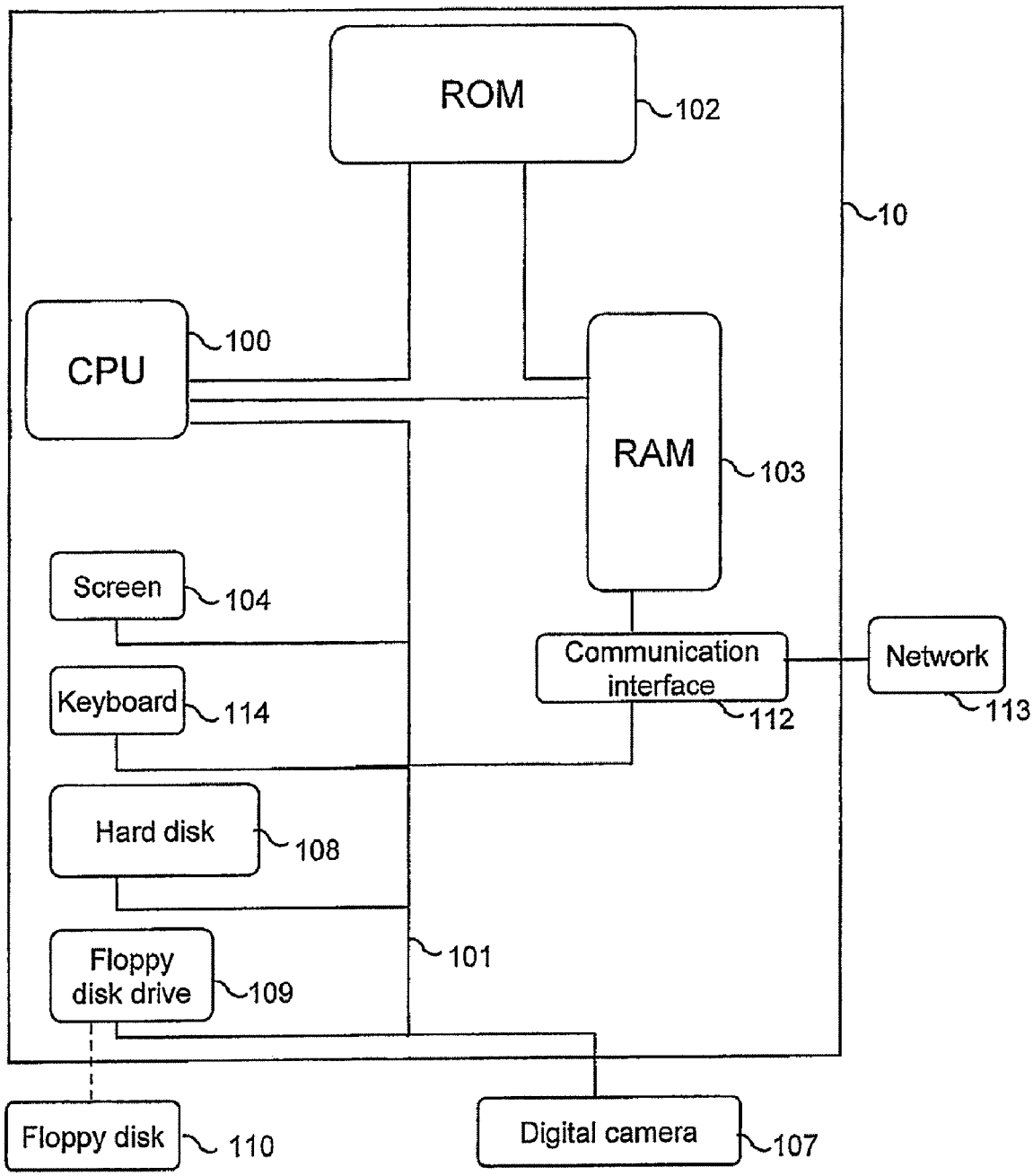
FIG. 2 depicts schematically a device adapted to implement the present invention, in a particular embodiment.

A device 10 implementing the coding method of the invention is illustrated in FIG. 2.

This device can for example be a microcomputer 10 connected to various peripherals, for example a digital camera 107 (or a scanner, or any image acquisition or storage means) connected to a graphics card and supplying information to be processed according to the invention.

The device 10 comprises a communication interface 112 connected to a network 113 able to transmit digital data. The device 10 also comprises a storage means 108 such as for example a hard disk. It also comprises a floppy disk drive 109. The floppy disk 110, like the hard disk 108, can contain data processed according to the invention as well as the code of the invention which, once read by the device 10, will be stored on the hard disk 108. As a variant, the program enabling the device to implement the invention can be stored in read only memory 102 (referred to as ROM in the drawing). As a second variant, the program can be received in order to be stored in an identical fashion to that described above through the communication network 113.

The device 10 has a screen 104 for displaying the data to be processed, that is to say the images, or serving as an interface with the user, who will be able to parameterize certain processing modes, by means of the keyboard 114 or any other means (a mouse for example).

The central unit 100 (referred to as CPU in the drawing) executes the instructions relating to the implementation of the invention, instructions stored in the read only memory 102 or in the other storage elements. On powering up, the programs and processing methods stored in one of the memories (non-volatile), for example the ROM 102, are transferred into the random access memory RAM 103, which then contains the executable code of the invention as well as registers for storing the variables necessary for implementing the invention. Naturally the floppy disks can be replaced by any information medium such as a CD-ROM or memory card. In more general terms, an information storage means, which can be read by a computer or by a microprocessor, which is integrated or not into the device, and which is possibly removable, stores a program implementing the method according to the invention.

The communication bus 101 enables communication between the various elements included in the microcomputer 10 or connected to it. The representation of the bus 101 is not limiting and, in particular, the central unit 100 is able to communicate instructions to any element of the microcomputer 10 directly or by means of another element of the microcomputer 10.

The device described here is able to contain all or part of the processing described in the invention.

Figure 3:
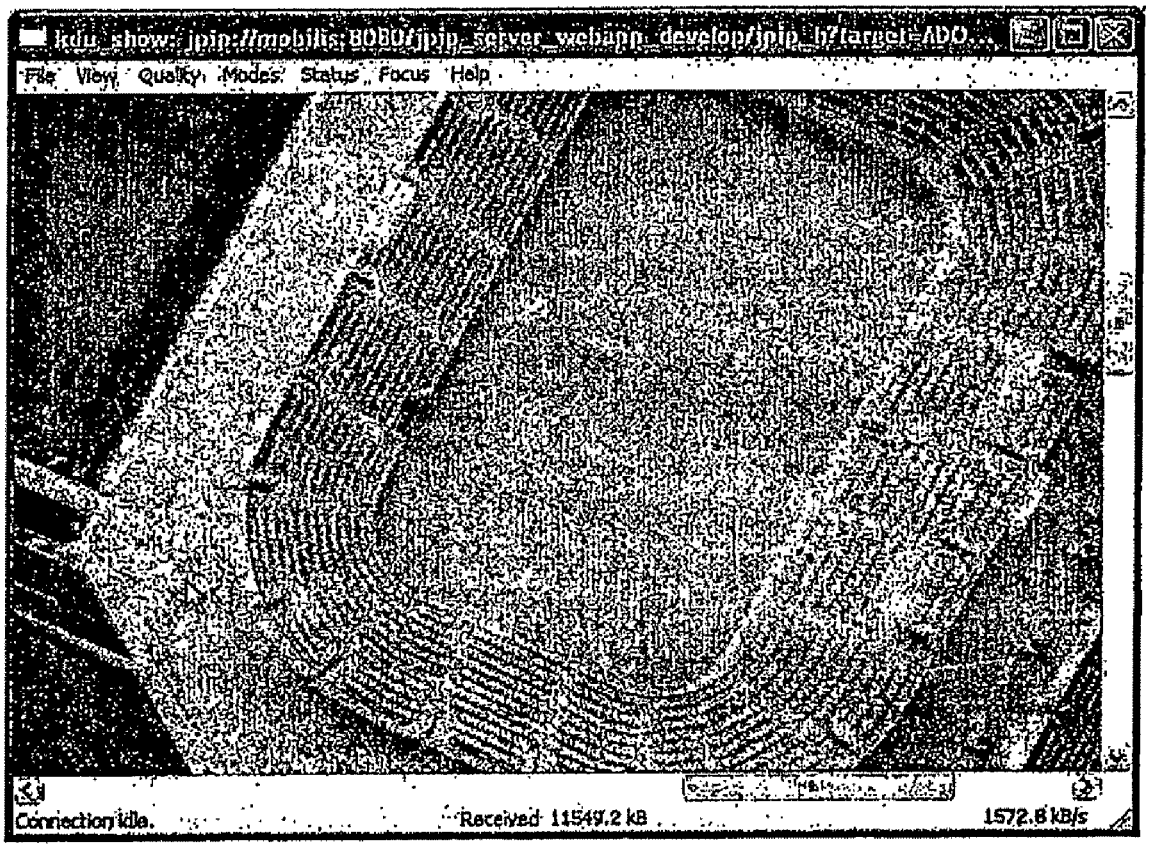
FIG. 3 illustrates the "kdu_show" graphical application supplied in the Kakadu software.

The Kakadu software, available on the Internet at the address http://www.kakadusoftware.com, supplies the application kdu_show, illustrated in FIGS. 3, 4*a* and 4*b*, 5*a* and 5*b* and 8. As shown by FIG. 3, the application kdu_show makes it possible to display JPEG2000 images decoded by the Kakadu decoder. The user can also perform zoom operations in order to change from one resolution level to another.

Once the image is displayed at a given resolution level, the user has the possibility of moving in the image by means of two scroll bars placed to the right of the image and below it. These scroll bars can be moved with the mouse or with the arrow keys of the keyboard.

In the kdu_show application, which uses the kdu_expand decoder, the decoding of the missing image areas, in order to respond to the operations performed on the image by the user, is always carried out from the top of the image to the bottom. The conventional Kakadu decoder is not in fact in a position to proceed from the bottom to the top. All the more so, no mechanism for decision between the two decoding directions is present in Kakadu.

FIG. 4*a* illustrates the example of a spatial movement towards the bottom of the image made by the user. As the drawing shows, this movement results in a missing area to be completed in order to satisfy the user request.

The conventional strategy adopted for filling in the missing area is illustrated by FIG. 4*b*. This consists of decoding and displaying the Image area commencing with the first line of the missing area. This decoding/display is systematically carried out from the top to the bottom of the image. This does not pose any problem in the case in FIG. 4*b* since no discontinuity is introduced between the area already present and the new area currently being decoded.

Nevertheless, other cases reveal the limits of the strategy adopted in Kakadu.

Thus FIG. 5*a* presents the case of a spatial movement towards the top of the image. In this case, the missing area caused by this movement is situated above the area already available on the screen.

FIG. 5*b* illustrates the strategy currently adopted by the Kakadu software for restoring the missing spatial area. That area is decoded systematically from top to bottom. As shown in FIG. 5*b*, this gives rise to a discontinuity between the lines already displayed in the new area and the area already present on the screen. In the case where the decoding and display operations take place at a sufficiently high speed, this does not pose any problem. On the other hand, if the restoration of the missing area is sufficiently slow for the user to be able to note the discontinuity created, this phenomenon may prove to be visibly unpleasant.

The company CANON CRF has developed a JPEG2000 plug-in for the Internet Explorer browser software. This plug-in is a sub-program of the browser and constitutes an interactive application for browsing JPEG2000 images. It is activated as soon as an Internet page is detected to contain a JPEG2000 image. The application thus developed is illustrated in FIGS. 6, 7*a*, 7*b*, 9*a* and 9*b*.

As shown by FIG. 6, the JPEG2000 plug-in makes it possible to integrate JPEG2000 images in Internet pages that are in accordance with the HTML format. Just like in the kdu_show application, the user can perform zoom-in/zoom-out operations as well as spatial movements in an image with a given resolution level. Unlike kdu_show, the movements are performed not by means of scroll bars, but using the mouse, by drag and drop operations. Visually, the image portion displayed is moved in the opposite direction to the movement made by the user in the image.

In the JPEG2000 plug-in, when the user makes a movement in the image, the missing area created consists of an L-shape. To complete the missing area, the plug-in breaks down the required L-shape into two rectangular sub-areas. These two rectangular sub-areas are systematically decoded and displayed from top to bottom. With regard to the L-shape display, reference can usefully be made to document FR-A-2 816 138.

In this interactive JPEG2000 application, there is no possibility of decoding from bottom to top (and therefore there needs to be no mechanism for deciding between the two decoding directions).

FIG. 7*a* illustrates a user spatial movement towards the top and towards the right, as well as the missing area (white) resulting from that movement.

FIG. 7*b* illustrates the problem which arises in the case of that movement. This is because the strategy usually adopted to fill in the missing area consists of carrying out, from the top of the new display window specified, the decoding and display of the missing area.

This leads to the same visual annoyance as in the case of FIG. 5*b*. This is because a discontinuity appears between the residue of the previously displayed area and the lines of pixels currently being displayed by the plug-in.

FIG. 8 illustrates the solution provided by the present invention to solve the problem of visual annoyance previously disclosed.

The solution proposed in the context of the kdu_show application consists, in the case of a movement of the user upwards, of beginning the decoding/display from the last line of the missing area. In addition, the decoding/display is carded out, not from top to bottom, but from bottom to top.

Note that in the case of a movement downwards, the direction of decoding and its starting point are unchanged compared with the original Kakadu strategy.

FIGS. 9*a* and 9*b* illustrate the solution proposed by the invention in the case of a movement in two directions. Such a movement typically occurs in the context of the JPEG2000 plug-in for an Internet browser, introduced above.

FIG. 9*a* illustrates a movement upwards and towards the right made by the user. It also illustrates the missing area created during that movement, and which the application must fill in. In the same way as in FIG. 8, when the user moves towards the top of the image, in accordance with the present invention, it is decided to decode and display the missing area from bottom to top.

In addition, FIG. 9*b* illustrates in more detail the strategy adopted in the case of a bidirectional movement. This is because the missing area is not a simple rectangle as in FIG. 8 but an L-shaped area. The invention proposes to break down the L-shaped area into two rectangles, which will constitute the two areas to be decoded and displayed successively by the application:

- the first rectangle, denoted Z1, is the rectangle alongside the area still displayed on the screen, of the same height as the latter;
- the second rectangle, denoted Z2, is the remainder of the missing area to be decoded once the first rectangle has been processed. Its width is always equal to that of the full current display window.

These two rectangles are decoded and displayed in that order. The same decoding direction (here upwards) is applied to the two rectangles.

Note that the case of FIG. 8 is a particular case of FIG. 9*b*, where the first rectangle would be of zero width, and would therefore not exist.

FIG. 10 introduces the notations and quantities manipulated in the algorithms which follow.

The full image is illustrated as well as two display windows W and W' successively required. As shown by FIG. 10, the display window W' results from a movement in the image, resulting from a request by the user, starting from the display window W. The origins of these two windows are expressed relative to the top left-hand point of the image and are respectively denoted (x, y) and (x', y').

The areas denoted Z1 and Z2 in FIG. 10 constitute the two rectangular portions of the image to be restored successively in order to satisfy the user request. Finally, as in FIGS. 9*a* and 9*b*, the decoding direction chosen here will be from bottom to top, since the movement takes place upwards ($y'<y$ in the reference frame (X, Y) illustrated in FIG. 10).

FIG. 11 presents roughly the global operating mode of an interactive browsing application in JPEG2000 images. The aim of this figure is to best determine where the decision algorithm peculiar to the present invention is situated.

First of all, a user event 115 corresponding to a spatial movement in the image and defining a direction of movement in the image is received in the form of a request coming from the man-machine interface 117. This movement is represented in the form of a new display window to be satisfied W'(x', y') (operation 119).

The decision algorithm included in the method according to the present invention is then executed (operation 121), in order to decide on the strategy for decoding and display of the missing spatial area resulting from the spatial movement. This algorithm is illustrated in FIG. 12 described below.

The decision taken by this algorithm, that is to say the decoding direction and the two areas Z1 and Z2 to be restored, are supplied to the decoding module (operation 123). The latter then executes the decoding of Z1 and then Z2 in that order (operation 125) and supplies the decompressed image portions to the display module (operation 127).

The display module then has the task of restoring and displaying the required rectangular areas in order to satisfy the user request (operation 129).

As a variant, the decoding and display operations may be implemented in several passes, in order to increase the resolution and/or quality of the areas to be restored, namely, Z1 and then Z2, so as to achieve progressive display using the decoding and display order chosen by the decision-taking mechanism 121.

The flow diagram in FIG. 12 illustrates the various steps of the algorithm provided by the invention for (i) taking a decision with respect to the decoding direction and (ii) determining the areas to be decoded. The algorithm is described here in no way limitingly for the above-mentioned two types of interactive applications for browsing in JPEG2000 images, namely, in the context of the kdu_show graphical application and in the context of the JPEG2000 plug-in for an Internet browser.

The inputs to the algorithm are:

- the current display window W(x, y, w, h, res [,qual]): the current display window of the user. The values x and y represent the origin (the top left-hand corner) of the window; (w, h) represents the size (width w, height h) of the window; res is the current resolution level In the JPEG2000 image; qual is a quality parameter, optional, specifying a number of quality layers of the image, a decoding rate or any other reconstruction quality factor;
- the new display window W'(x', y', w, h, res' [,qual']) resulting from the user movement. This window has a spatial position (x', y') and a resolution level res'.

In addition, in order to simplify the explanation of the algorithm in FIG. 12, it is considered that the sizes of the two display windows are identical. This is always true in the context of the JPEG2000 plug-in for an Internet browser. In the context of the application kdu_show, it is possible to recut the window of the graphical application. In such a case, filling in the created missing area amounts to filling a missing L-shaped area and the problem posed and solved as illustrated in FIGS. 9*b* and 12 is once again encountered.

It is considered therefore hereinafter that the two display windows are always of the same size (w, h).

The algorithm begins with a test 130. If the resolution level res' is different from the previous resolution level res, then this is no longer within the scope of the problem solved by this invention and the algorithm immediately ends.

In the contrary case, the algorithm continues. The following step consists of deciding on the direction of decoding of the image portions to be restored. For this, a test is carried out (test 132) to determine whether y' is less than y, which would mean that the user has moved upwards. In the affirmative, the decoding direction chosen is from bottom to top (decision 134). Otherwise, the decoding will take place in a conventional manner, from top to bottom (decision 136).

The following steps of the algorithm consist of testing (test 138) whether or not the two display windows overlap. If such is not the case, then a single area to be decoded Z1 is defined. This area Z1 has the same coordinates and the same size as the display window W' (block 140).

If W and W' overlap, then a test is carried out to determine whether x' is equal to x (test 142). If this test is positive, then this means that the user has performed a movement towards the top or towards the bottom but not to the sides. In this case, only the area Z2 in FIG. 10 will be decoded and displayed. The size (w2, h2) of the area Z2 is then given by (block 144):

w2=w (total width of the display window), h2=|y'−y| (length of the user movement).

The coordinates (x2, y2) of the area Z2 are given by:

x2=x (the x-axis of the display window W'), if y'<y then y2=y', otherwise y2=y+h.

If test 142 (x=x') were negative, then a test is carried out to determine whether y=y' (test 146). In the affirmative, the user movement is a movement in the horizontal direction. Only the area Z1 in FIG. 10 must therefore be decoded in this case. As shown by FIG. 12, this area then has a height equal to that of the total display window and a width equal to: |x'−x| (the length of the user movement) (block 148). In addition, the coordinates (x1, y1) of this area are given by:

if x'<x then x1=x' otherwise x1=x+w, y1=y (the y-axis of the display window W').

Finally, the third and last possible case is that where x'≠x and y'≠y (tests 142 and 146 negative). In this case, the two areas Z1 and Z2 of FIG. 10 exist and will have to be decoded and displayed in this order. As indicated in FIG. 12, the size of the area Z1 is: (w1, h1)=(|x'−x|, h−|y'−y|) (block 150). In addition, the coordinates of the area Z1 are as follows:

if x'<x then x1=x1 otherwise x1=x+w, if y'<y then y1=y otherwise y1=y'.

Likewise, the size of the area Z2 is: (w, |y'−y|) (block 150). The coordinates of the area Z2 are calculated as follows:

x2=x', if y'<y then y2=y' otherwise y2=y+h.

This defines completely the area or areas to be decoded and displayed when there is a spatial movement of the user in the image, for a constant resolution level.

Once the calculation of the area or areas to be decoded and displayed has ended, the algorithm of FIG. 12 ends. The outputs of this algorithm, supplied to the decoding module 125 in FIG. 11, are therefore the following parameters:

- the decoding direction used;
- the area or areas to be decoded and displayed, defined by their coordinates and their respective sizes. It should be noted that the resolution and the quality parameter associated with each area to be decoded are the same as those of the new display window W'.

According to the present invention, high reactivity of the interactive browsing application is provided by decoupling, i.e. parallel processing, of, on the one hand, calculations in connection with the decoding of JPEG2000 image portions on the display screen and, on the other hand, communication between the user and another entity, such as a remote distant server, for progressive and selective retrieving, by means of the JPIP protocol, of image data. This decoupling or parallel processing is achieved by separating these two major tasks through multithreaded processing.

Thus, the user has the possibility of moving in the current JPEG2000 image while the JPEG2000 decoder is decoding one of the areas Z1 or Z2 described previously with reference to FIG. 9*b*.

Consequently, it may be that a portion of the area which is currently being decoded becomes obsolete, when considering the current position of the user window $W_{current}$, before the two decoding operations performed for recovering the missing areas Z1 and Z2 are completed.

In such situations, the present invention provides the following strategy. If the user makes one or more movements in the image during the decoding of one of the two areas Z1 or Z2, then it is decided to complete the decoding of all portions of image lines which belong both to the area Z1, Z2 currently being decoded and to the new display window $W_{current}$.

The new area being decoded then becomes either $Z1 \cap W_{current}$ or $Z2 \cap W_{current}$. The decoding direction initially decided for the current decoding is maintained. The aim of the current decoding is to obtain an available displayed image area which is rectangular.

The lines of pixels that are currently being decoded can be shortened with respect to the lines of the original area Z1 or Z2 but cannot be lengthened.

In the case where the intersection between the area currently being decoded and $W_{current}$ is void, the current decoding stops immediately.

Once the current decoding is completed as explained above, as shown in FIG. 13*a*, the screen displays a valid decoded image area $Z_{available}$ of rectangular form, as well as a missing area. FIG. 13*a* illustrates the most general case, where a succession of user movements in all possible directions in the image has taken place, which creates a missing area located all around the area $Z_{available}$ already decoded and displayed. The cases where the missing area is a rectangular area as shown in FIG. 8 or an L-shaped area as shown in FIG. 9*b* are particular cases of the situation depicted in FIG. 13*a*.

The object of the present invention is to take a decision regarding the succession of image areas to be decoded and displayed, as well as regarding the direction of the decoding for each area, namely, from the top to the bottom or from the bottom to the top. In the most general case where the user makes spatial movements in all possible directions in the image during the original decoding of a missing image area, the decision-taking process described above with reference to FIGS. 10 and 12 is generalized, as shown in FIG. 13*b*.

The decision as to the areas to be decoded and displayed, the order and the direction in which each of the areas should be decoded and displayed is taken at a given time instant as a function of the orientation and direction of the last user movement in the image at that instant.

As shown in FIG. 13*b*, four cases of a user movement during the decoding are each represented by an arrow on the left of the image currently being decoded and displayed. The decision taken consists in decoding areas that are connected to the image portion which is already displayed on the screen, while "following" the current user movement.

Thus, if the last user movement is directed to the right and upwards (top left case illustrated in FIG. 13*b*), the first area to be decoded and displayed Z1 is the area on the right of the area already displayed and the decoding/display of Z1 is carried out from the bottom to the top. FIG. 13*b* illustrates, for each possible orientation and direction of the last user movement, the areas to decode and display and the order of decoding (Z1, Z2, Z3, Z4) and the direction of decoding (upwards or downwards) and display.

According to the algorithm described above with reference to FIG. 12, the first area to be decoded is the area which is located beside the area already displayed and which has the same height.

In addition, its relative position with respect to the area already displayed depends on the direction of the user movement: if the last movement was to the right, Z1 will be located on the right of $Z_{available}$ and otherwise, Z1 will be located on the left of $Z_{available}$.

The direction of decoding of Z1 also depends on the last user movement: if the latter was upwards, Z1 is decoded and displayed from the bottom to the top. Next, the area Z2 is located above or below $Z_{available}$, depending on the user movement, and Z2 has the same width as $Z_{available}$. If the last user movement was upwards, Z2 is above $Z_{available}$ and vice versa.

Similarly, the direction of decoding/display of Z2 is decided in the same manner as for Z1.

Next, the area Z3 is located beside the area $Z_{available}$ and opposite Z1. The decoding direction of Z3 is identical to that of Z1.

The last area Z4 to be decoded/displayed is located above or below $Z_{available}$ opposite Z2 and the decoding direction of Z4 is contrary to that of the first three areas Z1, Z2, Z3.

Part 2 of the JPEG2000 image compression standard provides an extended set of functionalities for compressing fixed images. In particular, it is possible, with compressed images in accordance with Part 2 of the standard, to perform rotations by an angle of 90°, 180°, 270° or vertical or horizontal symmetries in the compressed domain. Such methods of rotation and symmetry in the compressed domain are described in document FR-A-2 850 825.

In a particular embodiment where the image is in accordance with JPEG2000 Part 2, the methods of geometric transformation proposed in document FR-A-2 850 825 are easily combined with the ability of a decoder to process lines of pixels from the top to the bottom or from the bottom to the top of the image. Thus, a JPEG2000 decoder can be obtained which is capable not only to process lines of pixels in any direction, but also to process columns of pixels, either from the left to the right or from the right to the left.

FIG. 14 illustrates another embodiment of the present invention, where the image is in accordance with Part 2 of the JPEG2000 standard and where the pixels are decoded column by column and the decoding is performed from the right to the left.

As shown in FIG. 14, the decoding of the areas Z1 and Z3, that is to say, the missing areas located beside the area $Z_{available}$ already available on the screen, is performed, not line by line, but column by column. In addition, for either one of the areas Z1 and Z3, the decoding is carried out from the left to the right if the area is located on the right of $Z_{available}$ and from the right to the left in the contrary case.

This embodiment is particularly advantageous in the case of a simple user movement to the right or to the left, for example. In such a case, the visual rendition in the course of decoding and display is even better if the decoder processes column by column instead of processing line by line.

In another embodiment of the present invention, a mechanism of continuous display can be used. Such a mechanism consists in filling immediately the missing areas, namely, Z1 to Z4 in the previous examples, with available data, before any decoding operation. This can be achieved by storing in memory some bitmaps containing versions of the image previously displayed at resolution levels lower than the resolution level at which the image is currently displayed.

In most cases, the stored bitmaps can be used to apply an up-sampling operation to obtain data corresponding to the areas to be filled. However, in general, the data so obtained is of low visual quality because it comes from a low resolution level up-sampled. Therefore, a step of decoding supplementary data is necessary in order to enhance the visual quality of the areas to recover. In such a case, the current invention as described with reference to FIGS. 11 and 12 can still be advantageously applied to decode and display the supplementary data so as to improve the visual comfort for the user.

The invention claimed is:

1. A method of decoding and displaying a previously compressed digital image, a first portion of the image being previously decoded and displayed in a first display window, said method comprising the steps of:

reading a request of a user defining a movement direction representing the direction from the previously decoded and displayed first portion of the image to at least one undisplayed and coded area of the previously compressed digital image that will be decoded and displayed;

determining a new display window in the image as a function of the movement;

determining the at least one undisplayed and coded area of the previously compressed digital image to be decoded and a decoding direction of the at least one undisplayed and coded area of the previously compressed digital image from the relative position of the new display window with respect to the first display window;

decoding and displaying the at least one previously undisplayed and coded area of the previously compressed digital image according to the determined decoding direction.

2. A method according to claim 1, wherein the previously compressed digital image has previously been compressed by spatio-frequency transformation, quantization and entropic coding steps.

3. A method according to claim 1 or 2, wherein said decoding step comprises an inverse wavelet transform substep proceeding by successive lines of samples.

4. A method according to claim 1 or 2, wherein the decoding and display step is performed from the bottom to the top of the image if the value of the ordinate of the new display window is strictly less than the value of the ordinate of the first display window in a predetermined reference frame and the decoding and display step is performed from the top to the bottom of the image if the value of the ordinate of the new display window is strictly greater than the value of the ordinate of the first display window in the predetermined reference frame.

5. A method according to claim 1 or 2, wherein, in the case of a bidirectional movement made in the image by the user, there are determined, during said step of determining the at least one undisplayed and coded area to be decoded and a decoding direction:

a first rectangular area, situated alongside the part of said first portion still present in the new display window, with the same height as said part, and a second rectangular area, with a width equal to that of the new display window.

6. A method according to claim 5, wherein, during said step of determining the at least one undisplayed and coded area to be decoded and a decoding direction, the same decoding direction to be applied to the first and second rectangular areas is determined.

7. A method according to claim 5, wherein, during said decoding and display step, said second rectangular area is decoded and displayed after said first rectangular area.

8. A method according to claim 1 or 2, wherein the image conforms to the JPEG2000 standard.

9. An information storage device that is readable by a computer or a microprocessor, said information storage device storing instructions of a computer program, for implementing a decoding method according to claim 1 or 2.

10. An information storage device that is removable, partially or totally, and that is readable by a computer or microprocessor, said information storage device storing instructions of a computer program, for implementing a decoding method according to claim 1 or 2.

11. A computer program embodied on an information storage device which is loadable into a programmable apparatus, said program comprising sequences of instructions for implementing a decoding method according to claim 1 or 2, when this program is loaded into and executed by the programmable apparatus.

12. A device for decoding and displaying a previously compressed digital image, a first portion of the image being previously decoded and displayed in a first display window, said device comprising:

a unit that reads a request of a user defining a movement direction in the image representing the direction from the previously decoded and displayed first portion of the image to at least one undisplayed and coded area of the previously compressed digital image that will be decoded and displayed;

a unit that determines a new display window in said image as a function of said movement;

a unit that determines the at least one undisplayed and coded area to be decoded of the previously compressed digital image and a decoding direction of the at least one undisplayed and coded area of the previously compressed digital image from the relative position of the new display window with respect to the first display window;

a unit that decodes and displays the at least one previously undisplayed and coded area of the previously compressed digital image according to the determined decoding direction.

13. A device according to the claim 12, wherein the previously compressed digital image has previously been compressed by spatio-frequency transformation, quantization and entropic coding means.

14. A device according to claim 12 or 13, wherein said decoding unit comprises an inverse wavelet transformation unit adapted to proceed by successive lines of samples.

15. A device according to claim 12 or 13, wherein the decoding and display unit is adapted to proceed from the bottom to the top of the image if the value of the ordinate of the new display window is strictly less than the value of the ordinate of the first display window in a predetermined reference frame and the decoding and display unit is adapted to proceed from the top to the bottom of the image if the value of the ordinate of the new display window is strictly greater than the value of the ordinate of the first display window in the predetermined reference frame.

16. A device according to claim 12 or 13, wherein, in the case of a bidirectional movement made in the image by the user, said unit that determines the at least one undisplayed and coded area to be decoded and a decoding direction is adapted to determine:

a first rectangular area, situated alongside the part of said first portion still present in the new display window, with the same height as said part, and a second rectangular area, with a width equal to that of the new display window.

17. A device according to the claim 16, wherein said unit that determines the at least one undisplayed and coded area to be decoded and a decoding direction is adapted to determine the same coding direction to be applied to the first and second rectangular areas.

18. A device according to claim 16, wherein said decoding and display unit is adapted to display the second rectangular area after said first area.

19. A device according to claim 12 or 13, wherein the image conforms to the JPEG2000 standard.

20. A communication apparatus, comprising a decoding device according to claim 12 or 13.

21. A device for decoding and displaying a previously compressed digital image, a first portion of the image being previously decoded and displayed in a first display window, said device comprising:

means for reading a request of a user defining a movement direction in the image representing the direction from the previously decoded and displayed first portion of the image to at least one undisplayed and coded area of the previously compressed digital image that will be decoded and displayed;

means for determining a new display window in said image as a function of said movement;

means for determining the at least one undisplayed and coded area to be decoded of the previously compressed digital image and a decoding direction of the at least one undisplayed and coded area of the previously compressed digital image from the relative position of the new display window with respect to the first display window; and means for decoding and displaying the at least one previously undisplayed and coded area of the previously compressed digital image according to the determined decoding direction.

* * * * *